US008123027B2

(12) United States Patent
Kirkham

(10) Patent No.: US 8,123,027 B2
(45) Date of Patent: Feb. 28, 2012

(54) EXPLOSIVE DEPLOYMENT BAG

(75) Inventor: Jeffrey B. Kirkham, Portland, OR (US)

(73) Assignee: Jeffrey B. Kirkham, Portland, OR (US)

( * ) Notice: Subject to any disclaimer, the term of this patent is extended or adjusted under 35 U.S.C. 154(b) by 235 days.

(21) Appl. No.: 12/501,310

(22) Filed: Jul. 10, 2009

(65) Prior Publication Data

US 2010/0018426 A1 Jan. 28, 2010

Related U.S. Application Data

(60) Provisional application No. 61/137,195, filed on Jul. 28, 2008.

(51) Int. Cl.
*F42B 39/00* (2006.01)

(52) U.S. Cl. ..... 206/3; 206/388; 206/702; 190/109; 190/111; 102/324

(58) Field of Classification Search ..... 206/3, 303, 206/388, 409, 702, 570; 383/71, 72, 75, 383/77, 43; 102/321, 322, 330, 324; 190/107, 190/109, 111, 115

See application file for complete search history.

(56) References Cited

U.S. PATENT DOCUMENTS

| | | | | |
|---|---|---|---|---|
| 2,682,220 | A * | 6/1954 | Hagensen | 102/321 |
| 3,477,373 | A * | 11/1969 | Falterman et al. | 102/320 |
| 4,485,490 | A * | 12/1984 | Akers et al. | 2/457 |
| 4,513,665 | A * | 4/1985 | Ricketts et al. | 102/312 |
| 4,713,033 | A * | 12/1987 | Cameron | 441/84 |
| 5,337,891 | A * | 8/1994 | Toth | 206/316.2 |
| 5,586,655 | A * | 12/1996 | McBride | 206/388 |
| 5,743,447 | A * | 4/1998 | McDermott | 224/153 |
| 5,868,219 | A * | 2/1999 | Sadeck et al. | 182/70 |
| 6,186,662 | B1 * | 2/2001 | Jackson | 383/16 |
| 6,478,157 | B1 * | 11/2002 | Witt et al. | 206/702 |
| 6,880,702 | B1 * | 4/2005 | Colorado | 206/388 |
| 2005/0284717 | A1 * | 12/2005 | Chernoff | 190/18 A |

* cited by examiner

*Primary Examiner* — David Fidei
(74) *Attorney, Agent, or Firm* — Workman Nydegger

(57) ABSTRACT

An explosives deployment bag includes a main body portion having a chamber for containing and carrying at least one flexible material. The bag further includes a hole disposed through the main body portion through which a flexible elongate material can be controllably pushed or pulled into or out of and attached to one or more initiator(s). The bag also includes enclosing means disposed at the top of the main body portion for selectively covering the top of the main body portion through which another end of the flexible elongate material can be attached to a blasting material. A cap covers the blasting material and the top of the main body portion. Protective siding selectively covers the initiator(s). A handle and label means are also provided with the bag.

17 Claims, 4 Drawing Sheets

EXPLOSIVE DEPLOYMENT BAG

CROSS-REFERENCE TO RELATED APPLICATIONS

This application claims the benefit of U.S. Provisional application 61/137,195 filed Jul. 28, 2008 titled "EXPLOSIVES DEPLOYMENT BAG", which is incorporated herein by reference in its entirety.

BACKGROUND

Background and Relevant Art

The present invention relates to articles, such as bags, which can be used to carry explosives materials and which, in some embodiments, can be used for the deployment of the explosives materials.

Various types of bags and other carrying devices have been used in the deployment of explosives, in both open and covert breaching operations. However, there continues to be a general need for improved explosives deployment bags that can facilitate the overall convenience, speed and/or stealth at which the explosives can be deployed.

BRIEF SUMMARY OF THE INVENTION

The present invention includes articles of manufacture, such as explosives deployment bags, which are specifically configured for carrying explosives breaching materials. The present invention also includes explosives deployment kits, including explosives deployment bags that are equipped with explosives deployment materials that are usable for explosive breaching activities, as described in more detail below.

In some instances, the explosives deployment bag of the present invention provides organizational capabilities for both securely stowing and providing ready and convenient access to various explosives deployment components. This is also accomplished, according to some embodiments, while also reducing the tendency for certain components to become entangled. In this manner, and as described throughout this paper, the present invention can be used to improve the overall convenience, speed and/or stealth at which the explosives can be deployed.

One exemplary explosives deployment bag includes a main body portion including a bottom and a surrounding sidewall. The bottom and sidewall define an internal first containment means (e.g. a chamber) configured in size and shape for containing and carrying at least one flexible and elongate material. The bag further includes passage means (e.g., a hole) disposed in the main body portion through which the flexible elongate material can be controllably passed into or out of the first containment means of the main body portion. The bag further includes enclosing means disposed at the top of the main body portion for selectively covering the top of the main body portion and first containment means. The enclosing means may include an enclosing material that is attached to the sidewall of the main body portion, and that includes an elastic cord that is securely attached or threaded through the enclosing material. In operation, as the elastic cord is tightened, the enclosing material is drawn with the cord, covering the top of the chamber. Such enclosing means is selectively adjustable is size so as to cover a selectable portion of the top of the main body portion and chamber. The enclosing means aids in inserting or removing the flexible material from the chamber of the main body in a controlled fashion.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
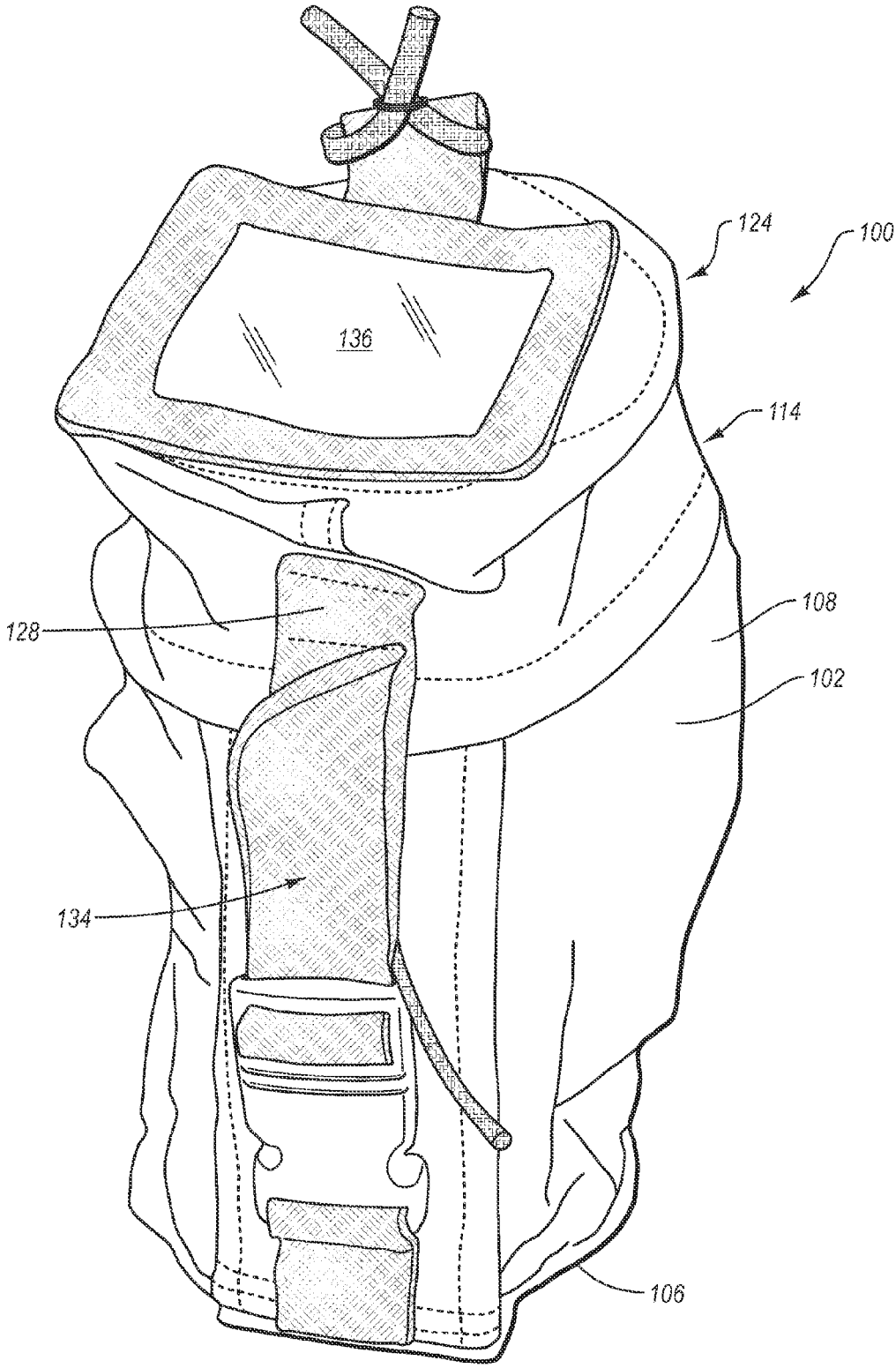
FIG. 1 illustrates a perspective view of an exemplary explosives deployment bag.

The present invention includes articles of manufacture, such as explosives deployment bags, which are specifically configured for carrying explosives breaching materials and in such a manner as to facilitate their use during explosive deployment activities.

The present invention also includes explosives deployment kits, including explosives deployment bags that are equipped with explosives deployment materials that are usable for explosive breaching activities, as described in more detail below.

The present invention also includes methods for using the explosives deployment bags and kits.

According to one embodiment, an inventive explosives deployment bag 100 includes a main body portion 102 comprising first containment means (e.g. a chamber 104) that is specifically configured for containing and carrying materials and products, such as, but not limited to flexible materials such as strings, cords, ropes, flexible wires, flexible optical fibers, and other flexible materials.

According to one preferred kit embodiment, the flexible elongate material contained within the main body portion 102 of the explosives deployment bag 100 is a flexible material that comprises a transfer means specifically configured for transferring a charge, current, light, chemical reaction or another type of reaction or energy manifestation from one end of the flexible material to another end of the flexible material in response to the detonation or activation of an initiator at one end of the flexible material.

In one embodiment, the flexible material or transfer means comprises No-Nail, a flexible material that is often used in explosives deployment for transferring energy or a reaction from a first end of a No-Nail cord to an opposing second end of the No-Nail cord. The reaction may occur in response to the detonation of one or more initiators at the first end, for example, such as, an M80 initiator and/or other initiators. Other types of reactions and energy transfer are also possible. Preferably, the reaction and/or the transfer of energy is sufficient to responsively detonate a blasting cap or other explosive's charge connected to the second end of the flexible material.

The main body portion 102 of the bag 100 includes a bottom 106 and a surrounding side wall 108. The bottom 106 and surrounding sidewall 108 can be composed of two distinct structural elements that are fixedly attached (such as by an adhesive, threading or other fastening means). In some embodiments, the bottom 106 and surrounding sidewall 108 are configured as one integral piece of material. Depending on specific needs and preferences, the bottom 106 can be configured to comprise a substantially flat and rigid surface or, alternatively, a flexible surface.

The main body portion 102 or first containment means (e.g. chamber 104) also includes a hole 110 or other passage means through which the flexible material or transfer means can be controllably pulled or pushed through. The passage means or hole 110 is preferably, although not necessarily, centrally located within the bottom 106 of the main body portion 102. The passage means can also be located at other areas in the bottom 106 or sidewall 108 of the main body portion 102.

At least one structural element or supporting means for maintaining and supporting the hole 110 preferably surrounds the hole 110 to provide support and to maintain a desired hole diameter. The at least one structural element can include threading, extra material, a grommet 112, and/or other structural elements. The diameter of the hole 110 is preferably larger than the thickness of the flexible material, so as to allow passage of the flexible material through the hole 110, but not so large that more than one cord of the flexible material can freely traverse the hole 110 at any one time. In some instances, however, it is desired to pass at least two or more cords through the hole 110 at one time to provide desired redundancies/safety factors. Different types of cords may also be contained in the bag 100 and may need to pass through the hole 110 at the same time. In any of the foregoing circumstances, the hole 110 is preferably configured in size to allow passage of only two, three or any other desired number of cords, depending on different needs and preferences.

The surrounding side wall 108 is attached to the bottom 106 of the bag 100, preferably around the entire perimeter of the bottom 106, and extends up from the bottom 106 of the main body portion 102 all the way up to a top 114 of the main body portion 102.

The top 114 of the main body portion 102 or first containment means (e.g. cavity 104) includes an enclosing means for covering or enclosing the top 114 of the main body portion 102. The enclosing means includes an enclosing material 116 that is attached to the surrounding side wall 108 (preferably around the entire perimeter of the surrounding side wall 108) and that extends away from the surrounding side wall 108 to an enclosing central ring 118.

The enclosing central ring 118 which is preferably configured to flexibly and/or elastically open and close in response to forces applied to the enclosing central ring 118. In some instances, the enclosing central ring 118 is a defined feature of the enclosing material 116. According to one embodiment, the central ring 118 includes a flexible cord 120, such as a bungee cord that is securely attached to or threaded through at least a portion of the enclosing material 116. According to another embodiment, the enclosing material 116 comprises a flexible/elastic type material that provides the desired flexibility or elasticity of the enclosing central ring 118, independent of any other material (e.g. bungee cord).

Flexibility or elasticity of the enclosing central ring 118 is desirable, according to one preferred embodiment, for enabling the central ring 118 to flexibly expand and constrict in response to forces exerted on the central ring 118, such as when a material or product is forcibly passed through the ring 118 while the ring 118 is in a closed position. For example, when the flexible material is being linearly extracted from the central ring 118, it is possible for an entangled knot or clump of flexible material to forcibly pass through the central ring 118, when an appropriate force is applied to cause the central ring 118 to expand, and so as to prevent the flexible material from becoming entrapped within the chamber 104 of the first containment means. Then, after the clump or knot is forcibly passed through the central ring 118 (during which the central ring 118 is temporarily expanded), the central ring 118 elastically constricts back into a closed position around the flexible material.

Figure 3:
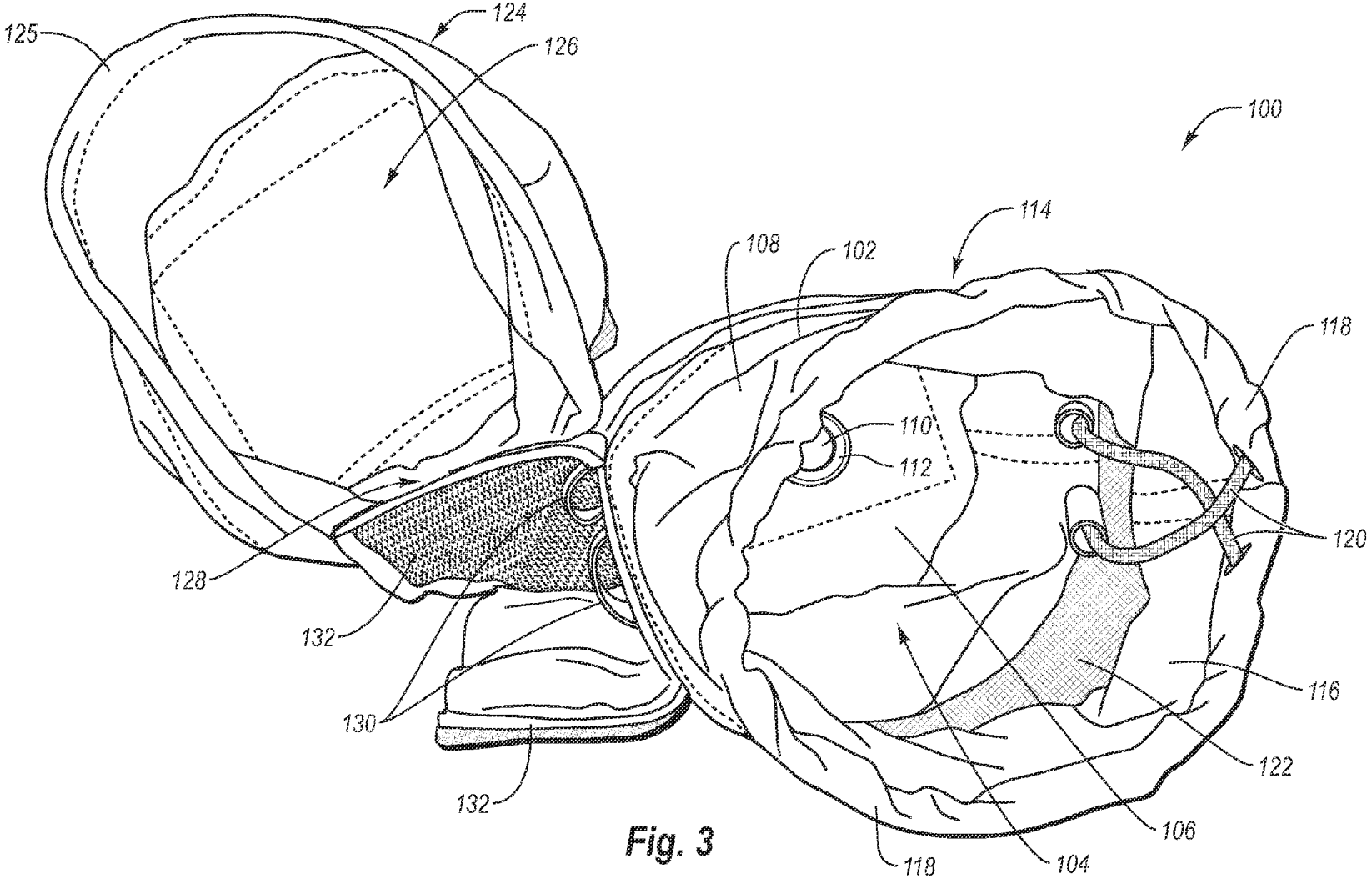
FIG. 3 illustrates a perspective view into a top of the explosives deployment bag of FIG. 1.

According to some embodiments, the enclosing ring 118 is configured to open large enough to easily and freely load the flexible material into the main body portion 102 through the ring 118. For example, as shown in FIG. 3, the enclosing ring 118 can sometimes open to such a degree as to have a same diameter as a diameter of the main body portion 102 and as defined by the side wall(s) 108.

Figure 4:
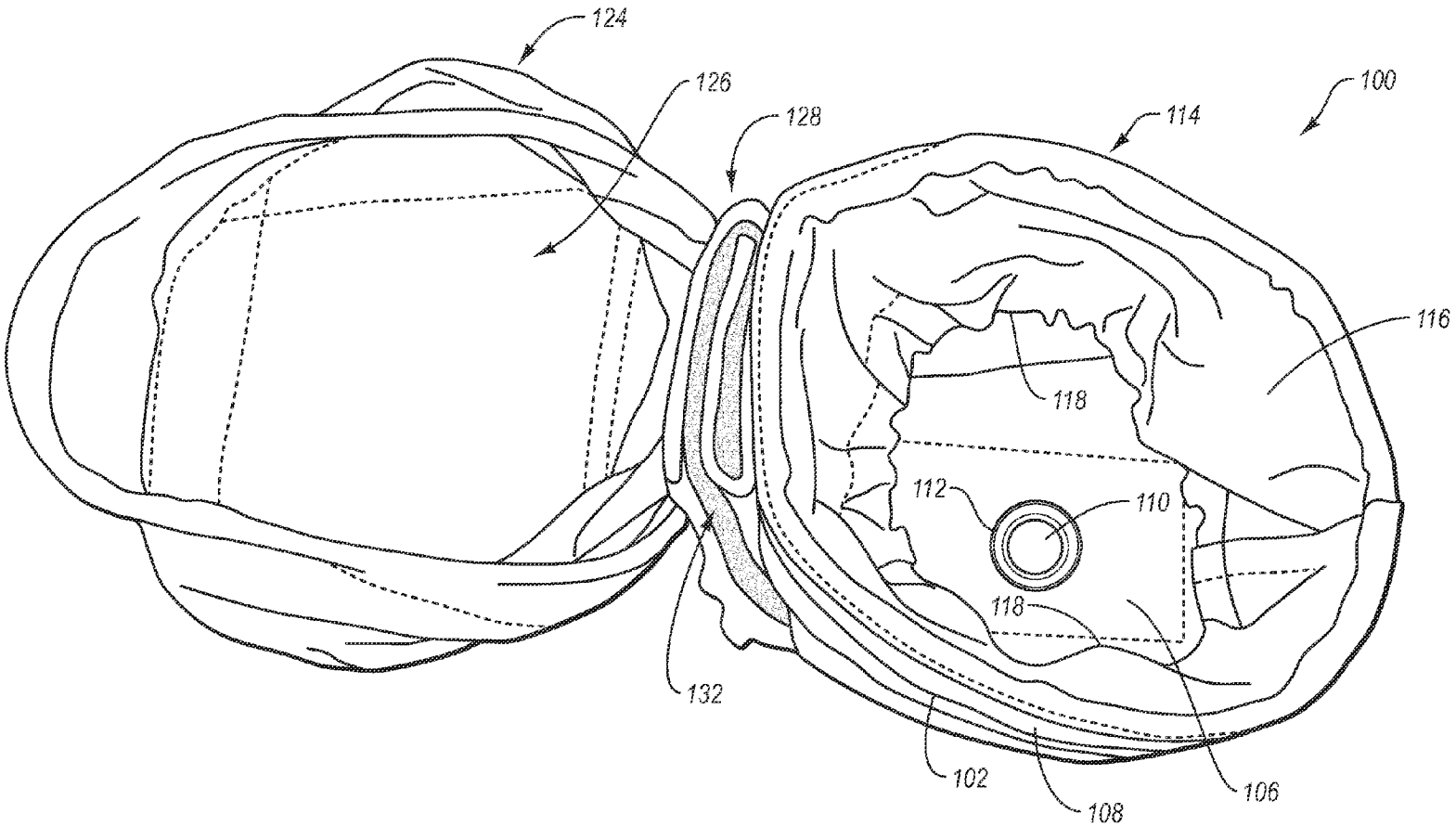
FIG. 4 illustrates a perspective view similar to that of FIG. 3, but in which an elastic central ring and associated enclosing material are partially closed.

The enclosing ring 118 is also configured to constrict or close to a diameter that is about as narrow as the thickness of the flexible material and such that only one cord (or any desired number of cords) of the flexible material can freely pass through the enclosing ring at one time and so as to prevent too much of the flexible material from escaping the main body portion 102 at any one time. In this manner, it is possible for the enclosing ring 118 to operate as a control means for controlling the manner in which the flexible material is extracted from the main body portion 102 (e.g. preferably in an untangled linear fashion). Notably, the enclosing ring 118 helps to shed and prevent tangles that might otherwise occur if the ring 118 were not present. In one embodiment, the ring 118 may close to a diameter approximately equal to that of hole 110. FIG. 4 illustrates ring 118 in a partially closed configuration.

A rim 122 or other supporting means that provides structural support to the top 114 of the main body portion 102 is also provided. Preferably, although not necessarily, the rim 122 circumferentially extends around the top 114 of the main body 102 near the seam between the sidewall 108 and the enclosing material 116. The rim 122 or other supporting means provides structural support to the top 114 of the main body 102 and in such a manner as to help prevent the surrounding sidewall 108 (at least near the top 114 of the main body 102) from collapsing inwardly towards the central ring 118 when an object or weight (such as a blasting cap attached to one end of the flexible material) is placed on the enclosing material 116. The rim 122 can include extra rigid material sewn into the sidewall 108 near the top 114 of the main body portion 102 (on the inside and/or the outside of the main body portion 102).

Rigidity of the sidewalls 108 can also help support the structural integrity of the main body portion 102 and can thereby help keep the main body 102 from collapsing when the objects are placed on the enclosing material 116. Rigidity of the sidewalls 108 can be provided, for example, by selecting appropriate materials and thicknesses for constructing the sidewalls 108 and/or by providing additional structural support, such as extra rigid fabric wires or plastic that is attached to the sidewalls. The rim 122 or other supporting means described above can also provide support to the sidewalls 108.

The explosives deployment bag 100 also includes a cap 124 including a second containment means (e.g. chamber 126) that is configured to securely envelop or engage the top 114 of main body portion 102 (i.e., the first containment means 104). The second containment means (e.g. chamber 126) is preferably configured in size and shape to be selectively and securely tightened in placed over the top 114 of the main body portion 102 as well as selectively removed from the top 114 of the main body portion 102 while still remaining attached to at least a portion of the main body 102 with a connection means 128 (such as fabric, a cord, a ring, Velcro, a zipper, or other connection means).

According to one embodiment, the cap 124 is configured in size and shape to securely engage the sidewall 108 of the main body portion 102 when the cap 124 is placed over the top 114 of the main body portion 102. The cap 124 is also preferably sized in such a way as to provide a sufficient chamber 126 for securely containing a blasting cap or other object(s) placed within the cap 124 and/or on top of the enclosing material 116 of the main body portion 102 when the cap 124 is securely placed over the top 114 of the main body portion 102.

In some embodiments, the cap 124 is also configured with fastening means for increasing the manner in which the cap is attached and securely fastened to the main body portion 102 when the cap 124 is placed over the top 114 of the main body portion 102. The fastening means (not shown) can include Velcro, zippers, snaps, bungee cords, other cords or strings, and other types of fastening means that are placed around the perimeter (inside and/or outside) of cap 124, such as, for example, around lip 125 of cap 124. Corresponding fastening means can also be placed on sidewall 108 of main body 102.

The explosives deployment bag 100 also includes securing means 130 for securing one or more initiators 131 (FIG. 2) adjacent to the sidewall 108 of the bag 100. The securing means 130 can include any securing means configured in size and shape to securely hold initiators 131 in place. According to one embodiment, the securing means 130 includes initiator holders made of elastic material sewn into the outside of the sidewall 108 of the main body portion 102, as perhaps best seen in FIG. 2. The securing means 130 can be configured to securely hold one, two, three or more initiators 131. The securing means can be configured to hold various quantities and sizes of initiators in both length and width.

Protection means 132 are also provided for protecting any initiator(s) held in place by the securing means 130. According to one embodiment, the protection means 132 includes foldable protection material such as Velcro (e.g. hook and loop) material that folds around the securing means 130 and any initiator(s) 131 held therein. In this regard, the protection means 132 further helps to secure and protect the initiator(s) 131.

In some instances, the protection means 132 is extended up to and connected to the cap 124 (FIGS. 2-4) in such a way that placing the cap 124 on the main body portion 102 causes the protection means 132 to be protectively folded around the top of any initiator(s) secured by the securing means 130.

The protection means 132 can also be configured in size and shape to further extend down and around the bottom 106 of the bag 100, covering the hole 110 in the bottom 106 of the bag 100 and helping to protect and hold any of the flexible material 133 (FIG. 2) in place that has been drawn out of the hole 110 to engage the initiator 131, for example. Preferably, the protection means 132 is configured to be detachably attached to the bottom 106 of the bag 100 and to detachably enclose the securing means 130.

The explosives deployment bag 100 also includes a fabric handle 134 or other handle means configured in size and shape for enabling a user to securely hold and handle the bag 100. Preferably, although not necessarily, the fabric handle 134 or other handle means is positioned on the outside of the bag sidewall 108. In some instances, this includes sewing a fabric handle 134 into the protection means 132, which is also attached to the outside of the bag sidewall 108.

The explosives deployment bag 100 also includes labeling structures 136 or other labeling means for labeling contents contained in the explosives deployment bag 100, such as when the explosives deployment bag 100 is used in kits that are equipped with explosives deployment materials (e.g. No-Nail cords, initiators, blasting caps, and so forth). The labeling means 136 is configured in some embodiments, with specific prepared text and fields or check boxes that identify specific materials. The labeling means 136 can also include fields for identifying dates of assembly, names of the one or more parties involved in the assembly, as well as special instructions and/or rules for using the explosives materials and bag 100. Preferably, the labeling means includes an interior chamber configured for holding a label and a transparent shield through which the label can be seen. The transparent shield is preferably attached in such a way to the bag as to hold the label in place. In other instances, the label 136 is a fabric label sewn directly onto the bag 100.

Although the bag 100 can be manufactured out of camouflage patterned materials, it will be appreciated that various different types of patterns and solid materials can also be used. It will also be appreciated that the bag 100 can be manufactured out of various different types of materials, including waterproof materials. The shape of the bag 100, while shown in a generally cylindrical shape, can also be manufactured into more spherical, rectangular or prismatic shapes.

In some embodiments, the invention includes obtaining a bag 100, as shown and described above, and loading the bag 100 with a flexible material, such as No-Nail, into the main body portion 102. A first end of the flexible material 133 is pulled through the hole 110 and attached to one or more initiators 131 that are secured by the securing means 130. The protection means 132 is closed about the securing means 130 and the hole 110, thereby holding the first end of the flexile material 133 in place and securing the initiators 131 in a protective state. A second end of the flexible material 133 is pulled through the enclosing ring 118 at the top 114 of the main body portion 102 and then the enclosing ring 118 is tightened around the flexible material 133. The second end of the flexible material 133 is then attached to one or more blasting materials 135 that are set on the enclosing material 116 and then the bag cap 124 is placed over the blasting materials 135 and secured in place. Preferably, the labeling means 136 is labeled appropriately, identifying date of preparation, materials used, and the name(s) of the assembler(s). Then the bag 100 along with all of the explosives materials and any label(s) comprise an explosives deployment kit usable in explosives breaching activities.

Although not shown, the bag can also include locking means for locking the bag cap 124 over the main body portion 102 and/or for locking the protection means 132 around the initiators and so as to prevent use of the bag 100 in explosives breaching activities without first unlocking the locking means. The locking means can include tamper-proof locks, key locks, combination locks or any other types of locks, with or without the use of zippers, for example, that line the cap 124 and/or protection means 132.

Figure 2:
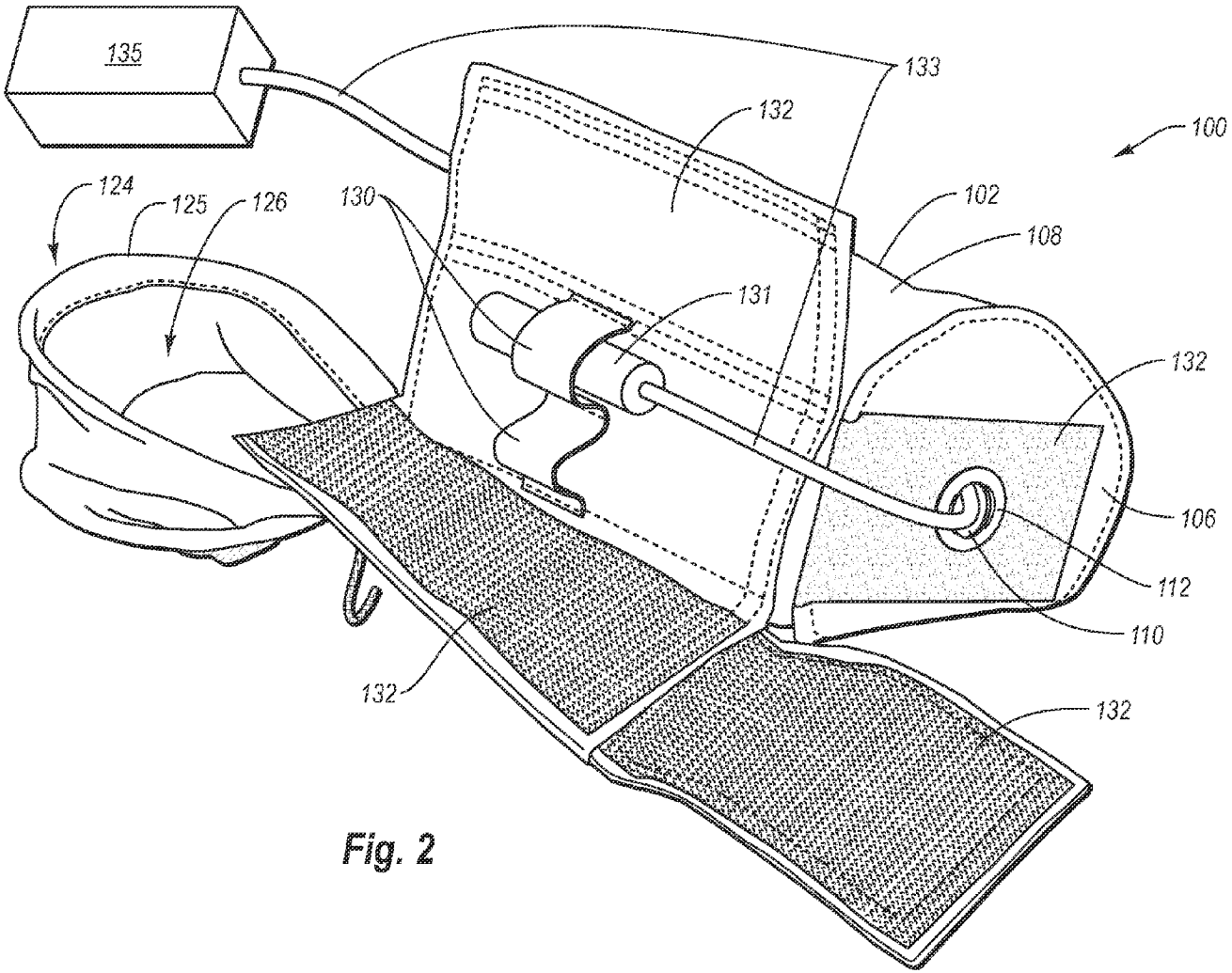
FIG. 2 illustrates the explosives deployment bag of FIG. 1 from a side perspective.

Although not described in extensive detail herein, the present invention also includes methods of using the above-described bags 100 and kits to perform explosives breaching activities, such as, for example, by carrying a bag to a detonation point, the bag containing explosives, an explosives transfer means, such as a No-Nail cord, and one or more initiator, as shown in FIG. 2. However, in some embodiments, it is not necessary that the transfer means is connected to one or more the initiator and explosives until after the explosives are placed in a desired destination for detonation. The method also includes extracting the explosives from the bag and placing the explosives at the intended detonation area and connecting the explosives to one end of the transfer means. The bag is then carried away from the detonation area to another area, at a preferably safe distance, while pulling necessary lengths of the transfer means out of the bottom of the bag. Next, if the initiator is not already connected to the other end of the transfer means, the initiator is exposed (by opening the protective covering on the bag, and connected to the transfer means. Then, the initiator is initiated to detonation of the explosive.

Finally, it will be appreciated that the present invention may be embodied in other specific forms without departing from its spirit or essential characteristics. The described embodiments are therefore to be considered in all respects only as illustrative and not restrictive.

What is claimed is:

1. An explosives deployment bag comprising:

a main body portion including a bottom and a surrounding side wall forming a container for containing and carrying at least one flexible and elongate material, wherein the bottom of the main body portion includes a hole through which the flexible and elongate material can be controllably extracted from the container, and wherein the exterior of the surrounding side wall includes one or more initiator holders for securing one or more initiators for initiating an explosion;

foldable protection material that is attached to the main body portion, the foldable protection material comprising two flaps that extend outwardly from the main body portion, wherein a first flap folds over the initiator holders and the second flap folds over the first flap and connects to a back side of the first flap when the first flap is folded over the initiator holders to thereby securely hold the foldable protection material over the initiator holders;

an enclosing central ring connected to a top of the main body portion along the perimeter of the surrounding sidewall, the enclosing central ring being selectively adjustable in size such that when the central ring is open, the at least one flexible and elongate material can be placed inside the container, and when the central ring is closed, an opening is provided that is sufficient to enable a single strand of each of the at least one flexible and elongate material to be threaded through the opening and when the central ring is closed, the central ring provides a supporting surface for supporting one or more blasting caps; and a cap that is attached to the main body portion, the cap forming a second container when placed overtop of the surrounding sidewall of the main body portion, the second container for containing the one or more blasting caps.

2. A bag as recited in claim 1, wherein the enclosing central ring is an elastic central ring such that when closed, the opening formed by the central ring expands as necessary as the flexible and elongate material is extracted through the opening.

3. A bag as recited in claim l wherein the surrounding side wall includes supporting material for providing structural support to the top of the main body portion to prevent the surrounding side wall from collapsing inwardly when weight is placed on the enclosing central ring.

4. A bag as recited in claim 3, wherein the supporting material comprises a rim of material circumferentially extending around the top of the main body portion proximate the enclosing central ring, the rim being disposed on or within the side wall near the top of the main body portion so as to lend additional rigidity to the top of the side wall.

5. A bag as recited in claim 1, wherein the initiator holders comprise elastic material.

6. A bag as recited in claim 1, wherein the second flap of the foldable protection material connects to the back side of the first flap via hook and loop fasteners.

7. A bag as recited in claim 1, wherein the second flap of the foldable protection material further extends down and around the bottom of the bag and detachably connects to the bottom of the bag to cover the hole so as to selectively protect and hold in place any flexible material that has been drawn out of the hole.

8. A bag as recited in claim 1, wherein the cap is further configured to be selectively and securely tightened around the surrounding sidewall of the main body portion.

9. A bag as recited in claim 1, further comprising a handle disposed on the outside of the bag configured in size and shape for enabling a user to securely handle the bag.

10. An explosives deployment bag comprising:

a main body portion forming a chamber for containing and carrying at least one flexible material for transferring a charge, current, light, or chemical reaction from a first end of the flexible material to a second end of the flexible material in response to the detonation or activation of an initiator attached to first end, the main body portion comprising a bottom and a surrounding side wall;

a hole disposed through the bottom of the main body portion which is aligned with a central axis of the main body portion and through which the flexible material can be controllably pulled from the chamber;

an enclosing material attached to the top of the surrounding side wall and that circumferentially extends away from the surrounding side wall;

an elastic flexible central ring operatively attached to the enclosing material, the enclosing central ring being configured to selectively and elastically open and close in response to forces applied to the central ring, wherein the attachment of the central ring to the enclosing material causes the enclosing material to cover the top of the main body portion and chamber when the central ring is in a closed configuration;

one or more elastic securing rings each for securing an initiator, the one or more elastic securing rings being attached to the exterior of the surrounding side wall of the main body portion;

a first flap attached to the main body portion and positioned to extend over the one or more elastic securing rings when folded over the one or more elastic securing rings;

a second flap attached to the main body portion and positioned to extend over the first flap when the first flap is folded over the one or more elastic securing rings, wherein an inside of the second flap and the outside of the first flap are configured with hook and loop fasteners to hold the second flap to the first flap over the one or more elastic securing rings, the second flap further extending around the bottom of the main body portion to secure the second flap to the bottom of the main body portion over the hole; and a cap attached to the main body portion that when placed over the elastic flexible central ring forms a second chamber within the bag for holding one or more blasting caps, the cap being configured to be tightened around the surrounding side wall of the main body portion to hold the cap in place overtop of the main body portion.

11. An explosives deployment kit comprising:

an explosives deployment bag including:

a main body portion including a bottom and a surrounding side wall forming a container and carrying at least one flexible and elongate material, wherein the bottom of the main body portion includes a hole through which the flexible and elongate material can be controllably extracted from the container, and wherein the exterior of the surrounding side wall includes one or more initiator holders for securing one or more initiators for initiating an explosion;

foldable protection material that is attached to the main body portion, the foldable protection material comprising two flaps that extend outwardly from the main body portion, wherein a first flap folds over the initiator holders and the second flap folds over the first flap and connects to a back side of the first flap when the first flap is folded over the initiator holders to thereby securely hold the foldable protection material over the initiator holders;

an enclosing central ring connected to a top of the main body portion along the perimeter of the surrounding sidewall, the enclosing central ring being selectively adjustable in size such that when the central ring is open, the at least one flexible and elongate material can be placed inside the container, and when the central ring is closed, an opening is provided that is sufficient to enable a single strand of each of the at least one flexible and elongate material to be threaded through the opening and when the central ring is closed, the central ring provides a supporting surface for supporting one or more blasting caps; and a cap that is attached to the main body portion, the cap forming a second container when placed overtop of the surrounding sidewall of the main body portion, the second container for containing the one or more blasting caps.

12. A kit as recited in claim 11, wherein the flexible and elongate material comprises transfer means specifically configured for transferring a charge, a current, light, or a chemical reaction from one end of the flexible and elongate material to another end of the flexible and elongate material in response to detonation or activation of an initiator at one end of the flexible and elongate material.

13. A kit as recited in claim 11, wherein the hole is centrally located within the bottom of the main body portion, the diameter of the hole being larger than the thickness of the flexible and elongate material so as to freely allow passage of the flexible and elongate material through the hole.

14. A kit as recited in claim 13, wherein the diameter of the hole is small enough so that no more than one cord of the flexible and elongate material can freely traverse the hole at any one time.

15. A kit as recited in claim 11, further comprising labeling means for labeling contents and/or other information relative to materials included in the explosives deployment kit.

16. A kit as recited in claim 11, further comprising one or more initiators secured within the one or more initiator holders.

17. A method of assembling an explosives deployment kit comprising:

obtaining an explosives deployment bag, the explosives deployment bag comprising:

a main body portion including a bottom and a surrounding side wall forming a container for containing and carrying at least one flexible and elongate material, wherein the bottom of the main body portion includes a hole through which the flexible and elongate material can be controllably extracted from the container, and wherein the exterior of the surrounding side wall includes one or more initiator holders for securing one or more initiators for initiating an explosion;

foldable protection material that is attached to the main body portion, the foldable protection material comprising two flaps that extend outwardly from the main body portion, wherein a first flap folds over the initiator holders and the second flap folds over the first flap and connects to a back side of the first flap when the first flap is folded over the initiator holders to thereby securely hold the foldable protection material over the initiator holders;

an enclosing central ring connected to a top of the main body portion along the perimeter of the surrounding sidewall, the enclosing central ring being selectively adjustable in size such that when the central ring is open, the at least one flexible and elongate material can be placed inside the container, and when the central ring is closed, an opening is provided that is sufficient to enable a single strand of each of the at least one flexible and elongate material to be threaded through the opening and when the central ring is closed, the central ring provides a supporting surface for supporting one or more blasting caps; and a cap that is attached to the main body portion, the cap forming a second container when placed overtop of the surrounding sidewall of the main body portion, the second container for containing the one or more blasting caps;

loading at least one flexible and elongate material into the container formed by the main body portion;

pulling a first end of the flexible and elongate material through a the hole in the main body portion of the bag;

connecting the first end of the flexible and elongate material to one or more initiators that are secured within the one or more initiator holders;

folding the foldable protection material over the one or more initiator holders thereby holding the first end of the flexible and elongate material in place and securing the initiators in a protective state;

pulling a second end of the flexible and elongate material through an the enclosing central ring at the top of the and then tightening the enclosing central ring around the flexible and elongate material;

attaching the second end of the flexible and elongate material to at least one of the one or more blasting caps that are set on the supporting surface provided by the enclosing central ring; and engaging a the cap over the top of the main body portion of the bag so that the cap covers the one or more blasting caps.

* * * * *